United States Patent [19]

Kelly

[11] Patent Number: 4,487,431

[45] Date of Patent: Dec. 11, 1984

[54] PUBLICATION CONVERTIBLE TO POSTER AND REMOVABLE INSERT AND METHOD OF MAKING SAME

[75] Inventor: John M. Kelly, Bloomfield, Conn.

[73] Assignee: The Stanley Works, New Britain, Conn.

[21] Appl. No.: 282,751

[22] Filed: Jul. 13, 1981

[51] Int. Cl.[3] ..... B42D 15/00

[52] U.S. Cl. ..... 283/1 R; 206/232; 229/92.8; 281/1; 281/29; 283/34; 283/56; 283/61; 283/62; 283/63 R; 283/64

[58] Field of Search ..... 283/1 R, 1 A, 34, 56, 283/63 R, 61, 62, 64; 281/1, 29, 38, 2, 5; 40/124.1, 530; 229/92.8; 206/232; D19/1, 6, 7, 8

[56] References Cited

U.S. PATENT DOCUMENTS

| | | | |
|---|---|---|---|
| 512,882 | 1/1894 | Hillhouse | 283/34 |
| 1,076,257 | 10/1913 | Wiltz | 40/530 |
| 1,276,454 | 8/1918 | Van Deventer | 283/63 R |
| 1,405,193 | 1/1922 | Favreau | 281/1 |
| 1,510,194 | 9/1924 | Radford | 283/56 |
| 1,578,895 | 3/1926 | Joyce | 283/63 R |
| 2,156,815 | 5/1939 | Levy | 281/15 R |
| 2,169,932 | 8/1939 | Sweet et al. | 283/1 R |
| 2,181,588 | 11/1939 | Purvis | 281/33 |
| 2,208,213 | 7/1940 | Ericson | 281/33 |
| 2,314,790 | 3/1943 | Jenter | 281/16 |
| 2,417,982 | 3/1947 | Histed | 229/92.8 |
| 2,631,046 | 3/1953 | Stephens | 283/56 |
| 3,248,806 | 3/1966 | Schrader | 283/34 X |
| 3,479,752 | 11/1969 | Crigar | 281/16 X |
| 3,738,686 | 6/1973 | Morse | 283/63 R |
| 3,750,309 | 8/1973 | Tovar | 283/63 X |
| 3,755,925 | 9/1973 | Court | 281/29 |
| 3,968,573 | 7/1976 | Poliniere | 283/1 A X |
| 3,970,332 | 7/1976 | Alford, Jr. | 40/124.1 X |
| 4,183,162 | 1/1980 | Applebaum et al. | 40/350 |
| 4,270,773 | 6/1981 | Gaetano | 283/61 X |

OTHER PUBLICATIONS

"Wild Cats of the World", a poster of the National Geographic Society, Copyright 1981.

Swingline Corp. removable add, in Jun., 1973, issue of *Office Products.*

*Primary Examiner*—Paul A. Bell

[57] ABSTRACT

A publication consists of a folded cover sheet within which is assembled an insert of printed pages. The cover sheet is appropriately printed to provide a front cover page when folded and an integrated poster on its normally concealed side when unfolded, and the insert pages are dimensioned and configured for convenient and protected disposition therewithin.

6 Claims, 4 Drawing Figures

PUBLICATION CONVERTIBLE TO POSTER AND REMOVABLE INSERT AND METHOD OF MAKING SAME

BACKGROUND OF THE INVENTION

It is not uncommon for companies and other organizations to periodically distribute to their existing and potential customers, and to institutions such as schools and the like, publications providing information of educational, instructional, entertainment or general-interest value. Such publications may be used as a commercial vehicle for stimulating interest and for providing sales of goods and services, or they may be used primarily for altruistic purposes. In any event, for greatest convenience and effectiveness the materials will desirably take a variety of forms; e.g., relatively small pages of textual, pictorial and graphic materials may be included for individual use, and relatively large sheets may be used as posters, prints, plans, and the like, for group display and presentation. In such a publication, the degree of permanency of individual items may vary, often depending upon whether or not they are to be discarded or retained, and in some instances they may have added features, such as holes for binding, elements for mounting, etc.

Despite the advantages of including materials of different forms in a single issue of such a publication, it is nevertheless desirable that the several parts thereof be assembled as a neat and compact package, since doing so will greatly facilitate mailing and shipping, and will enhance the convenience of distribution and use. Moreover, it is desirable that the more substantial parts of the assembly provide protection against exposure and abuse of other parts, and to the publication as a whole.

Accordingly, it is an object of the present invention to provide a novel publication consisting of a cover, providing a poster sheet, and an insert of pages, which publication is neat and compact and affords facile mailing and shipping, and convenient distribution and use.

It is also an object of the invention to provide such a publication in which parts cooperate to provide protection against exposure and abuse, and in which aesthetic appeal and commercial impact are afforded.

Another object of the invention is to provide a novel method by which such a publication can be produced.

SUMMARY OF THE INVENTION

It has now been found that certain of the foregoing and related objects of the invention are readily attained in a convertible publication, including a cover and an insert, the insert being comprised by a multiplicity of integrated pages and being removably assembled within the cover. The cover comprises a single large sheet of relatively heavy-weight material, which is printed on both sides and is folded at least twice upon itself along perpendicular fold lines to form at least four substantially identically dimensioned and configured panels. One of the sides of the sheet is exposed, to provide four readily-visible pages comprising the front and rear inside cover pages, with the other of the sides being normally concealed. At least the front outside cover page and one other of the visible pages has printed indicia thereon, and the surfaces of the panels on the normally concealed side of the sheet have matter printed thereon to present an integrated visual impression comprised thereof, and to provide a poster when the sheet is unfolded. The pages of the insert are of substantially the same configuration as the panels, and are of dimensions not exceeding those of the panels. The insert pages are attached to one another, in pairs or greater numbers, along their aligned edge margins disposed at the fold line between the front and rear cover pages, so as to dispose the insert between the inside cover pages and to cause the insert to be enveloped by the cover.

In preferred embodiments of the publication, the sheet of heavy-weight material is folded only twice, and each of the visible pages has printed indicia thereon. It may be especially desirable to have the printed indicia on the contiguous inside or outside cover pages present an integrated visual impression, so as to provide a two-page spread when the cover is unfolded along the common fold line between the contiguous pages. Generally, the insert pages will have dimensions that are substantially the same as those of the panels, and at least some of the pages may be adapted for permanent retention.

Other objects of the invention are attained in a novel method comprising, as a first step, printing both sides of a large sheet of relatively heavy-weight material. The sheet is folded at least twice upon itself along perpendicular fold lines to form at least four substantially identically dimensioned and configured panels; as folded, one of the sides of the sheet is exposed, to provide four readily-visible pages comprising the front and rear inside and outside cover pages, and the other side is concealed. The front outside cover page and at least one other of the visible pages have printed indicia thereon. Similarly, the concealed side of the sheet has printed matter on the surfaces of its panels, to present an integrated visual impression comprised thereof and to provide a poster when the sheet is unfolded. A multiplicity of printed pages are provided having substantially the same configuration as the panels of the cover sheet, and having dimensions not exceeding those of the panels. The pages are joined to one another, in pairs or in greater numbers, with their edge margins along one side thereof aligned, thereby providing an insert of pages. Finally, the insert is disposed within the cover between the front and rear cover pages, with the aligned edge margins disposed at the fold line therebetween, whereby the cover envelopes the insert and a convertible publication is provided.

DETAILED DESCRIPTION OF THE ILLUSTRATED EMBODIMENT

Figure 3:
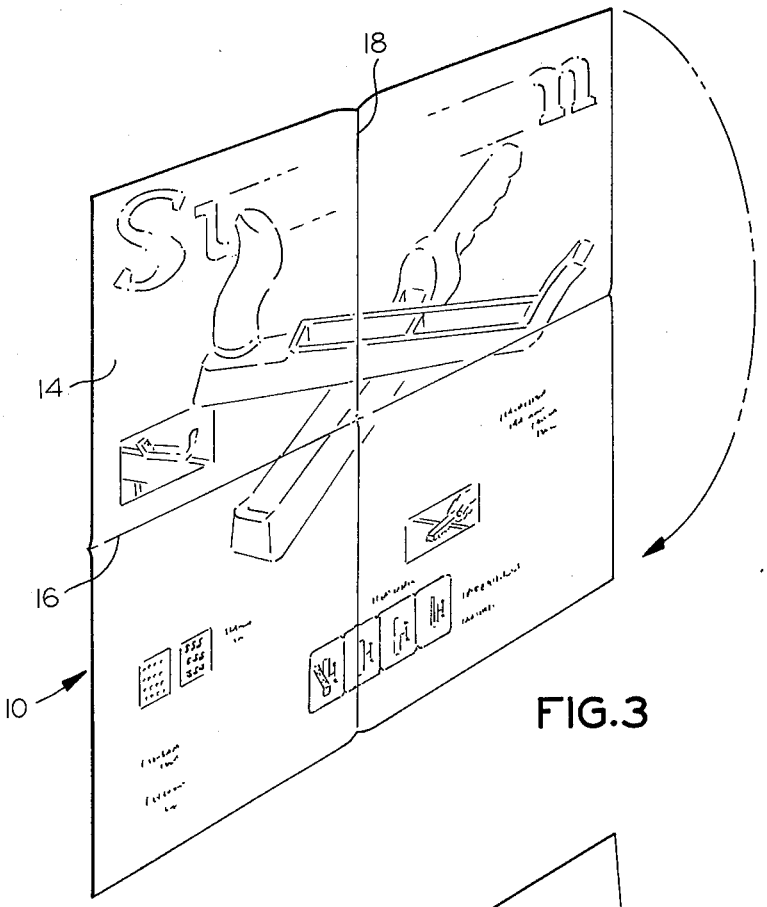
FIG. 3 is a perspective view of the fully unfolded sheet of material constituting the cover of the publication.

Turning now in detail to the appended drawings, therein illustrated is a publication embodying the present invention and consisting of a cover, generally designated by the numeral 10, and an insert of pages, generally designated by the numeral 12. As is best seen in FIG. 3, the cover 10 consists of a single, relatively large sheet of material (usually, a sheet of fairly heavy-weight paper) which is printed on both sides, but with only the normally concealed surface 14 being visible in this figure. The sheet is creased along perpendicular axes or fold lines at 16 and 18, to divide it into four panels of substantially identical dimensions and configuration, with the printed matter within the panels on surface 14 of the sheet presenting an integrated visual impression, thus constituting the sheet of cover 10 as a poster than can be mounted on a wall or the like.

Figure 4:
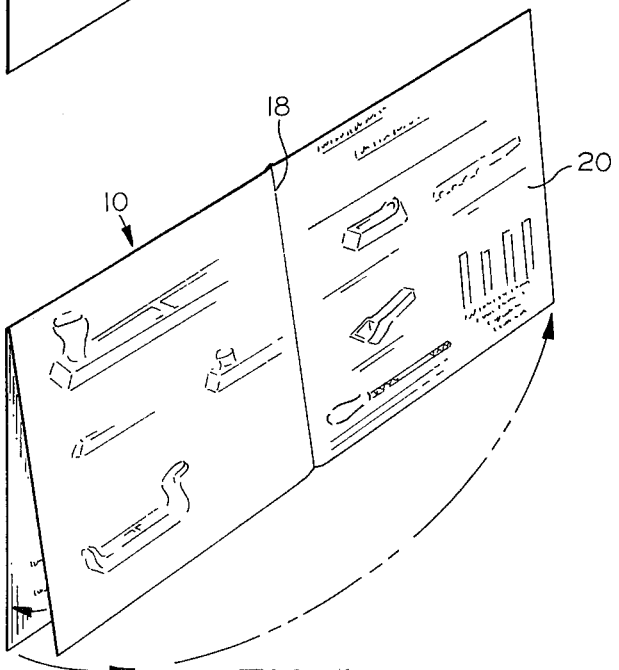
FIG. 4 is a perspective view showing the cover sheet partially folded from the position of FIG. 3.

With particular reference now to FIG. 4, the sheet has been folded along crease line 16 to dispose it in the two-panel form depicted therein. Printed matter on side 20 (the reverse of side 14) of two contiguous panels of the sheet is shown, and it will be noted that they also cooperate to form a second integrated visual impression, thereby constituting a two-page spread. It will be appreciated that the matter on surface 14 will be concealed upon folding of the sheet along crease line 16, as indicated by FIG. 4.

Figure 1:
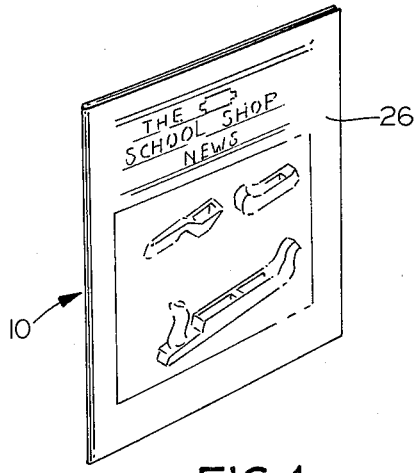
FIG. 1 of the drawings is a perspective view of a publication embodying the present invention.
Figure 2:
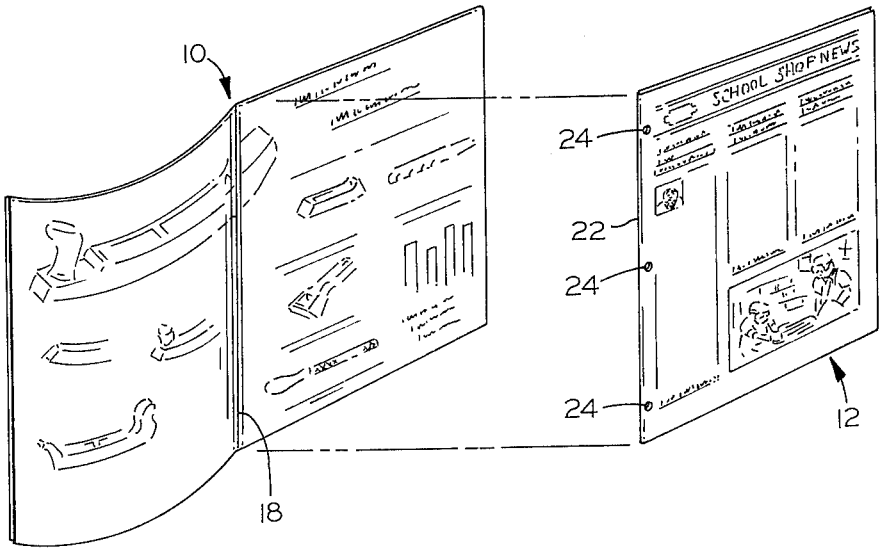
FIG. 2 is an exploded perspective view of the publication of FIG. 1, showing the cover in an open position and showing the insert pages removed therefrom.

Insert 12 is shown in FIG. 2, and is comprised of a multiplicity of pages that are dimensioned and configured substantially identically to the panel defined by the crease lines 16, 18 of the sheet forming the cover 10. The pages of insert 12 are, in this instance, of double-panel (or tabloid) format and are interfolded to provide a common marginal edge 22, although individual, single-panel size pages may instead or additionally comprise the insert. Three holes 24 are formed along the folded edge of each of the double pages, and the corresponding holes 24 are aligned to permit the entire insert of pages to be permanently retained in a standard three-ring binder. Thus, the insert 12 is adapted to lie within the cover 10 with the edge 22 of the insert disposed along the crease 18 of the cover, so as to permit the cover 10 to enfold and completely envelope the pages of the insert 12 therewithin. As seen in FIG. 1, the assembled publication presents a uniform appearance, with the pages of the insert 12 protected within the cover 10. It will be appreciated that the front outer page 26 of the cover 10 is provided by one of the contiguous panels on the exposed side of the sheet when it is disposed as illustrated in FIG. 4 (but which surface is not visible therein), and that the rear outer page of the cover 10 is provided by the other panel surface contiguous thereto.

While paper will most generally be used, the several parts of the publication may of course be made of other materials. For example, stiffened cloth web, plastic film or sheet, etc., may be employed if desired, such as to afford enhanced permanency or greater protection, and especially insofar as the cover sheet construction is concerned. Printed indicia will generally be provided over substantially the entire area on both sides of the cover sheet, but in any event the normally concealed surface will bear indicia cooperatively providing an integrated poster representation (either graphical, pictorial, textual, or a combination thereof), and the panel providing the outside front cover page will also be printed. Usually, both the front and rear outside cover pages will have printed indicia thereon, and the inside front and rear panel pages may have integrated printed matter thereon, conveniently providing a two-page spread. Thus, the cover sheet may at the same time provide a four-panel poster, a two-page spread, and decorative and/or informative front and rear outside cover pages, the printed matter on which pages may or may not be integrated to provide a second two-page spread.

The insert will normally consist of four or more assembled paper pages, which may be joined in pairs along a marginal fold and interfold together, in typical tabloid newspaper format. Alternatively, the several pages comprising the insert may be single sheets attached to one another by any suitable means, such as by edge binding. In any event, the insert will be adapted for assembly within the cover, with an edge of the insert disposed at the fold line between the front and rear cover pages. The insert will be dimensioned and configured relative to the cover panels to achieve that relationship; i.e., the configuration of the insert will be similar to that of the panels, and will be smaller or of substantially the same size. Parts of the insert may advantageously be adapted for permanent reference retention, and means (such as the holes of the illustrated embodiment) may be provided for that purpose.

The publications herein described may be used to achieve any of numerous objectives, and may contain subject matter that is informative, educational, entertaining and/or promotional, depending upon the particular objectives sought. Moreover, a variety of different materials, forms and formats may be employed for the cover and/or the insert parts, again to best accomplish a particular purpose. It is to be appreciated that, as used herein, the terms "printed matter" or "printed indicia" are intended in their broadest sense to include reproduction by any suitable means, such as by use of conventional printing techniques, photographic reproduction, xerographic copying, etc.

Thus, it can be seen that the present invention provides a novel publication consisting of a cover providing a poster sheet, and an insert of pages, which publication is neat and compact and affords facile mailing and shipping as well as convenient distribution and use. The parts comprising the publication cooperate to provide protection against exposure and abuse, as well as aesthetic appeal and commercial impact. A novel method by which such a publication can be produced is also provided.

Having thus described the invention, what is claimed is:

1. A convertible publication including a cover and a removable insert comprised of a multiplicity of integrated pages removably assembled therewithin, said cover comprising a single large sheet of relatively heavy-weight material printed on both sides and folded at least twice upon itself along perpendicular fold lines to form at least four substantially identically dimensioned and configured panels, one of said sides of said sheet being exposed to provide four readily-visible pages comprising the front and rear inside and outside cover pages, and the other of said sides being normally concealed, at least said front outside cover page and one other of said visible pages having printed indicia thereon, one of said front and rear outside cover pages having a portion thereof with mailing indicia thereon so that said cover functions as the mailer for the publication, and the surfaces of said four panels on said normally concealed side of said sheet having indicia printed thereon cooperatively providing an integrated poster representation comprised of all four panels thereof, to provide a poster when said sheet is unfolded, the pages of said insert being of substantially the same configuration as said panels and of dimensions approximating but not exceeding those of said panels, said insert pages being attached to one another in pairs or greater numbers along their edge margins disposed at the fold line between said front and rear cover pages, and said insert being removably disposed between said inside cover pages and enveloped by said cover.

2. The publication of claim 1 wherein said sheet of heavy-weight material is folded upon itself only twice, and wherein each of said visible pages has printed indicia thereon.

3. The publication of claim 2 wherein the printed indicia on the contiguous inside or outside cover pages present an integrated visual impression, thereby providing a two-page spread when said cover is unfolded along the common fold line between said contiguous pages.

4. The publication of claim 1 wherein said insert pages are sheets folded along a center line to provide four panels and are adapted for permanent retention by a multiplicity of apertures adjacent the fold line therein to facilitate placement in a binder, said cover being essentially free from perforations.

5. The publication of claim 1 wherein said sheet of heavy-weight material is paper.

6. In a method for the production of a publication that is convertible to a poster and a removable insert, the steps comprising:

(a) printing both sides of a large sheet of relatively heavy-weight material;

(b) folding said sheet of material at least twice upon itself along perpendicular fold lines to form at least four substantially identically dimensioned and configured panels, one of said sides of said folded sheet being exposed to provide four readily-visible pages comprising the front and rear inside and outside cover pages, and the other of said sides being concealed, said front outside cover page and at least one other of said visible pages having printed indicia thereon, one of said front and rear outside cover pages having a portion thereof with mailing indicia thereon so that said cover functions as the mailer for the publication, and the four panels of concealed side of said sheet having printed indicia thereon cooperatively providing an integrated poster representation comprised of all four panels thereof and to provide a poster when said sheet is unfolded, (c) providing a multiplicity of printed pages having substantially the same configuration as said panels of said cover sheet, and having dimensions approximating but not exceeding those of said panels, said pages being joined to one another, in pairs or greater numbers, with their edge margins along one side thereof aligned, to provide an insert of pages; and (d) disposing said insert within said front and rear cover pages with said aligned edge margins disposed at the fold line therebetween, and with said cover enveloping said insert, to provide said convertible publication.

* * * * *